US008985129B2

(12) United States Patent
Li et al.

(10) Patent No.: US 8,985,129 B2
(45) Date of Patent: Mar. 24, 2015

(54) SUNSHADE UMBRELLA CAPABLE OF ADJUSTING UMBRELLA SURFACE ANGLE

(71) Applicant: Hangzhou China Arts Industrial Corp., Ltd., Hangzhou (CN)

(72) Inventors: Ren Li, Hangzhou (CN); Yunsheng Wang, Hangzhou (CN)

(73) Assignee: Hangzhou China Arts Industrial Corp., Ltd., Hangzhou (CN)

( * ) Notice: Subject to any disclaimer, the term of this patent is extended or adjusted under 35 U.S.C. 154(b) by 0 days.

(21) Appl. No.: 13/942,517

(22) Filed: Jul. 15, 2013

(65) Prior Publication Data

US 2014/0158173 A1 Jun. 12, 2014

(51) Int. Cl.
*A45B 17/00* (2006.01)
*A45B 23/00* (2006.01)

(52) U.S. Cl.
CPC ..... *A45B 17/00* (2013.01); *A45B 2023/0043* (2013.01); *A45B 2023/0081* (2013.01)
USPC ..... 135/20.1

(58) Field of Classification Search
CPC ..... A45B 2023/0081; A45B 2023/0043
USPC ..... 135/20.1, 20.3, 21
See application file for complete search history.

(56) References Cited

U.S. PATENT DOCUMENTS

| | | | | |
|---|---|---|---|---|
| 6,588,438 | B1 * | 7/2003 | Steiner | 135/20.1 |
| 6,840,253 | B2 * | 1/2005 | Ma | 135/20.1 |
| 7,156,114 | B2 * | 1/2007 | Lo | 135/21 |
| 7,398,790 | B2 * | 7/2008 | Glatz | 135/20.1 |
| 7,493,909 | B2 * | 2/2009 | Ma | 135/20.3 |
| 7,533,680 | B2 * | 5/2009 | Ma | 135/21 |
| 7,708,022 | B2 * | 5/2010 | Joen-an Ma | 135/20.1 |
| 7,913,707 | B2 * | 3/2011 | Lai | 135/21 |
| 7,958,901 | B2 * | 6/2011 | Lai | 135/20.3 |
| 8,104,492 | B2 * | 1/2012 | Dan | 135/20.3 |
| 2003/0010366 | A1 * | 1/2003 | Glatz | 135/21 |

* cited by examiner

*Primary Examiner* — Noah Chandler Hawk
(74) *Attorney, Agent, or Firm* — Pearne & Gordon LLP

(57) ABSTRACT

The present invention discloses a sunshade umbrella capable of adjusting umbrella surface angle, including an upright rod and an upright rod handle which moves up and down along the upright rod, wherein one end of the upright rod is connected with umbrella base, the other end of the upright rod is hinged with the connecting rod, the other end of the connecting rod is hinged with a circumferential fixed hanger rod, the hanger rod is hinged with the upright rod handle, an umbrella surface angle adjusting device is mounted on one end of the hanger rod, an executing device that takes the circumferential movement around the hanger rod is mounted on the other end of the hanger rod, and the executing device is connected with an upper umbrella plate. This umbrella has the following advantages: increased overall firmness of the sunshade umbrella, simple structure, and is convenient to operate.

19 Claims, 4 Drawing Sheets

SUNSHADE UMBRELLA CAPABLE OF ADJUSTING UMBRELLA SURFACE ANGLE

CROSS-REFERENCE TO RELATED APPLICATIONS

This application claims the benefit of Chinese application 201220556955.1, filed Oct. 29, 2012, the disclosure of which is hereby incorporated by reference in the present disclosure in its entirety.

FIELD OF THE INVENTION

The present invention relates to a sunshade umbrella capable of adjusting umbrella surface angle.

BACKGROUND OF THE INVENTION

Currently, various types of sunshade umbrella capable of adjusting umbrella surface angle on the market have different specific adjusting device , including internal and external gear axial movement type, worm and gear type, and the type that two end face gear plate are separated by the engaging of push rod and spring. But such adjusting devices are complex, cumbersome to assembly, and having high manufacture costs. Additionally, there is only one connecting rod equipped between the adjusting device and the umbrella stand, so the overall firmness is low and the adjusting device is easy to damage.

SUMMARY OF THE INVENTION

The technical problem to be solved by the invention is directed to provide a sunshade umbrella capable of adjusting umbrella surface angle, which is convenient to operate, manufacture and assemble and also have simple and reliable structure.

To solve the above technical problem, the present invention provides a sunshade umbrella capable of adjusting umbrella surface angle, including a upright rod and a upright rod handle which moves up and down along the upright rod, wherein one end of the upright rod is connected with umbrella base, the other end of the upright rod is hinged with the connecting rod, the other end of the connecting rod is hinged with a circumferential fixed hanger rod, the hanger rod is hinged with the upright rod handle, an umbrella surface angle adjusting device is mounted on one end of the hanger rod, an executing device that takes the circumferential movement around the hanger rod is mounted on the other end of the hanger rod, the executing device is connected with an upper umbrella plate, and the executing device includes an adjusting connector, an adjusting connecting rod and an end sleeve of hanger rod, wherein the end sleeve of hanger rod is sleeved on the hanger rod, the adjusting connector is fixedly connected with the end sleeve of hanger rod, one end of the adjusting connector is fixedly connected with the adjusting connecting rod, the other end of the adjusting connector is hinged with the upper umbrella plate, and the other end of the adjusting connecting rod is connected with the umbrella surface angle adjusting device. The umbrella surface angle adjusting device and the executing device is connected with each other respectively by the hanger rod and the adjusting connecting rod, so as to improve the overall firmness and enhance the wind resistance.

Preferably, the umbrella surface angle adjusting device includes a shell, an adjusting button, an outer ring gear and a positioning member. the positioning member is engaged with the outer ring gear, two ends of the outer ring gear are provided with sliding bearings, the sliding bearing is circumferential movably connected with the shell, a compressed spring is sleeved on the positioning member, the end of outer ring gear is abutted with the guide groove on the shell, the outer ring gear is fixedly connected with the hanger rod, one end of the adjusting button is hinged with the shell, and the other end of the adjusting button is hinged with the positioning member. A waist-shaped hole is formed on the adjusting button and located at the site where the adjusting button is hinged with the shell, the pin roll located on the shell moves along the waist-shaped hole, and the adjusting connecting rod is fixedly connected with the shell. After the positioning member is detached from the outer ring gear, the shell can do the circumferential movement around the hanger rod, the adjusting connecting rod is driven by the shell to rotate angle, and then the end sleeve of hanger rod is driven to do the circumferential movement around the hanger rod, so as to adjust the umbrella surface angle; when the outer ring gear is engaged with the positioning member, the adjustable connecting rod is made to do circumferential location, so as to position the umbrella surface angle.

Preferably, the positioning member is a stepped pin, a meshing member that is meshed with the outer ring gear is located at the large diameter end of the stepped pin, the small diameter end of the stepped pin is hinged with the adjusting button, the compressed spring is located at the small diameter end of the stepped pin, one side of the compressed spring is abutted with the large diameter end of the stepped pin, the other side of the compressed spring is abutted with the guide groove on the shell. With the meshing contact way, the contact area is increased; the circumferential positioning device is more solid and durable.

Preferably the stepped pin is integrally molded with the engaging member. The stepped pin is integrally cast with the meshing member, to have a higher strength.

By adopting the above structure, compared with the prior art, the sunshade umbrella capable of adjusting umbrella surface angle of the present invention has the following advantages: increased overall firmness of the sunshade umbrella, simple structure, convenient to operate, and easy to manufacture, so the drawbacks in the prior art such as complex structure, cumbersome assembly and inconvenient operation can be solved.

Figure 1:
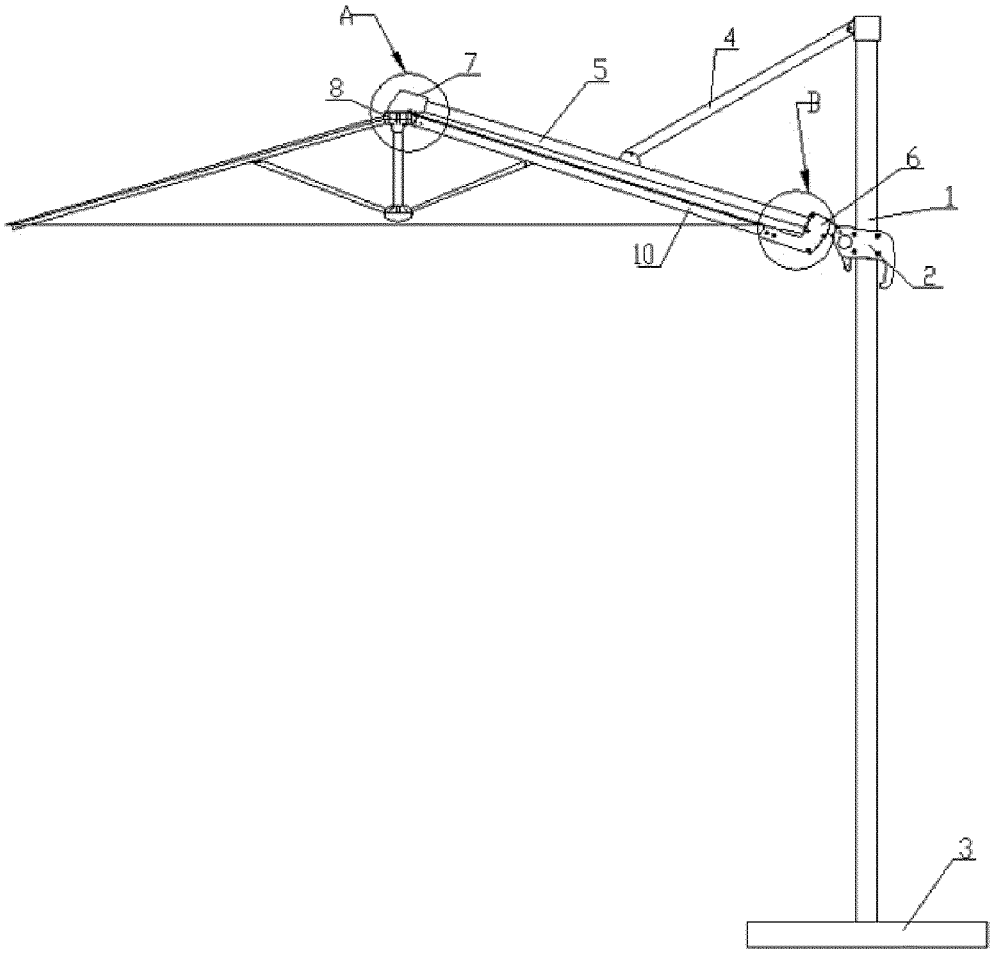
FIG. 1 is structure schematic diagram of the present invention.

In which: upright rod 1, upright rod handle 2, umbrella base 3, connecting rod 4, hanger rod 5, umbrella surface angle adjusting device 6, executing device 7, upper umbrella plate 8, adjusting connector 9, adjusting connecting rod 10, end sleeve of hanger rod 11, shell 12, adjusting button 13, waist-shaped hole 14, outer ring gear 15, sliding bearing 16, positioning member 17, compressed spring 18, guide groove 19.

DETAILED DESCRIPTION OF THE INVENTION

As follows, the present invention is further described in detail with the aid of embodiments and accompanying figures.

As shown in FIG. 1, The embodiment provides a sunshade umbrella capable of adjusting umbrella surface angle, including a upright rod 1 and a upright rod handle 2 which moves up and down along the upright rod, wherein one end of the upright rod 1 is connected with umbrella base 3, the other end of the upright rod 1 is hinged with the connecting rod 4, the other end of the connecting rod 4 is hinged with a circumferential fixed hanger rod 5, the hanger rod 5 is hinged with the upright rod handle 2, an umbrella surface angle adjusting device 6 is mounted on one end of the hanger rod 5, an executing device 7 that takes the circumferential movement around the hanger rod 5 is mounted on the other end of the hanger rod 5, and the executing device 7 is connected with an upper umbrella plate 8. The executing device 7 includes an adjusting connector 9, an adjusting connecting rod 10 and an end sleeve of hanger rod 11, wherein the end sleeve of hanger rod 11 is sleeved on the hanger rod 5, the adjusting connector 9 is fixedly connected with the end sleeve of hanger rod 11, one end of the adjusting connector 9 is fixedly connected with the adjusting connecting rod 10, the other end of the adjusting connector 9 is hinged with the upper umbrella plate 8, and the other end of the adjusting connecting rod 10 is connected with the umbrella surface angle adjusting device 6.

Figure 2:
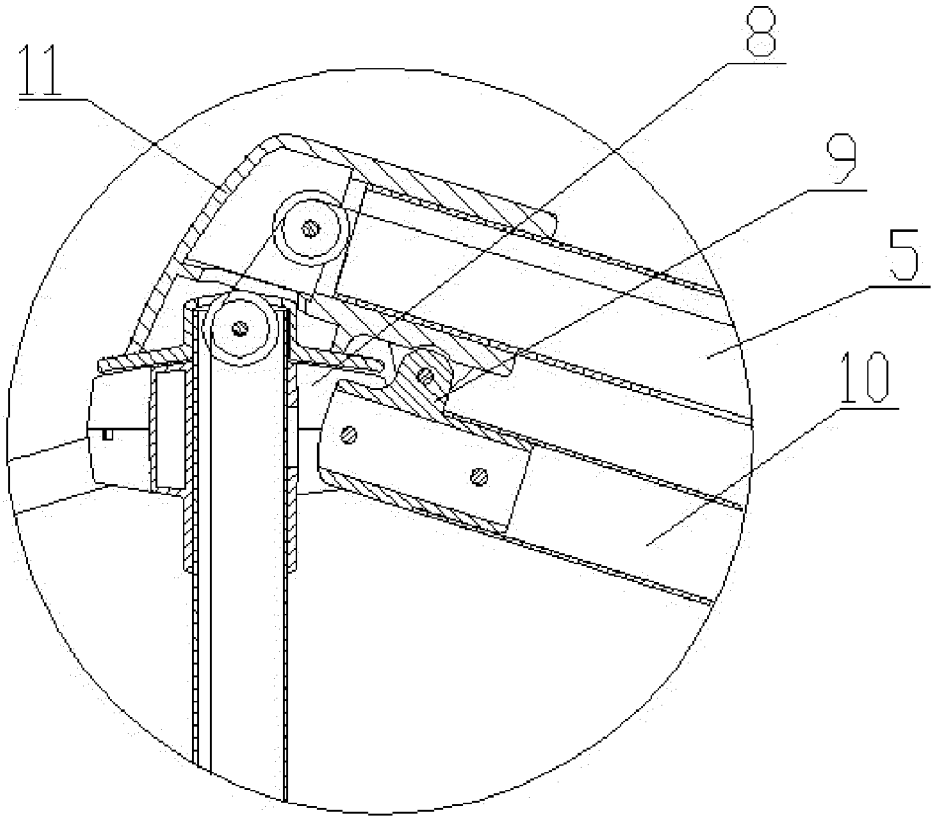
FIG. 2 is a partially enlarged view of the present invention A.
Figure 3:
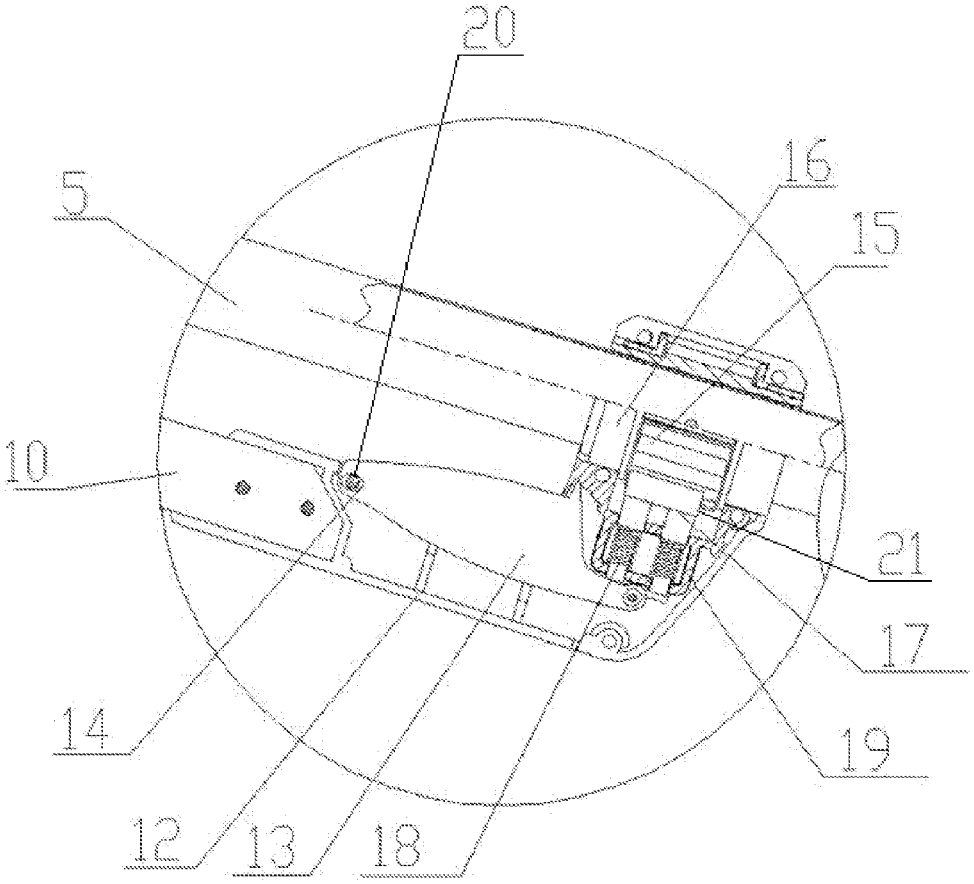
FIG. 3 is a partially enlarged view of the present invention B.
Figure 4:
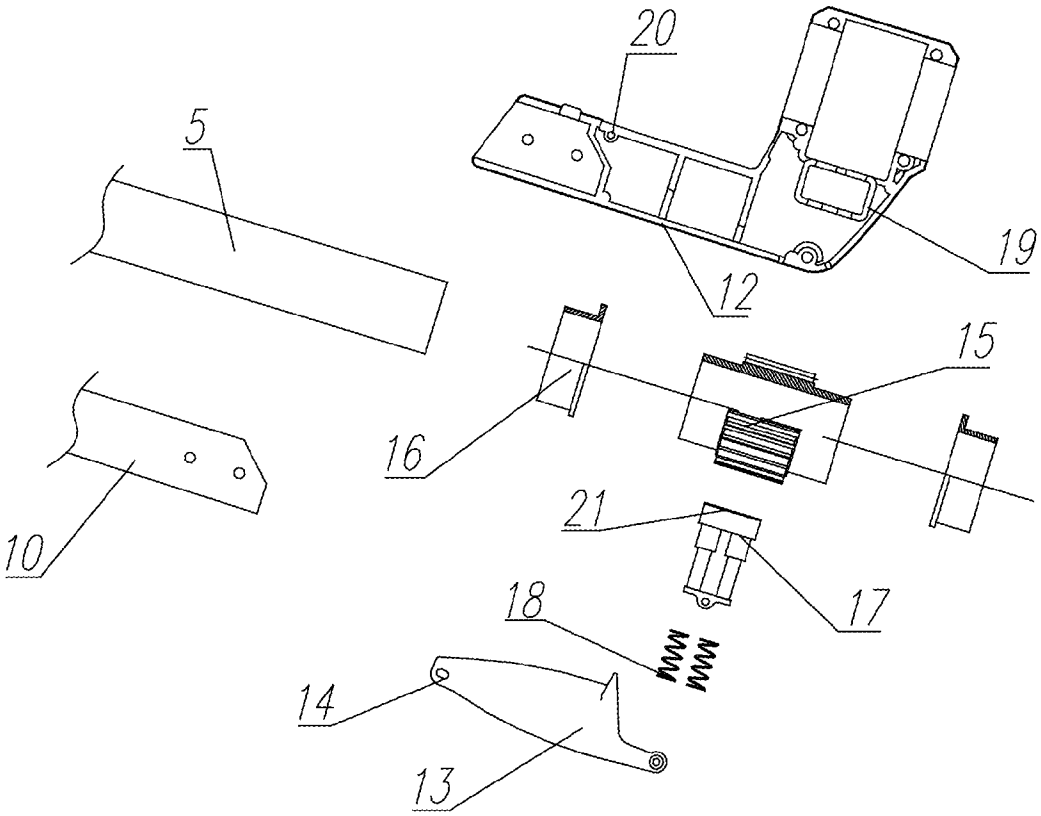
FIG. 4 is an exploded view of the of an umbrella surface angle adjusting device of the present invention.

As shown in FIGS. 2-4, the umbrella surface angle adjusting device 6 includes a shell 12, an adjusting button 13, an outer ring gear 15 and a positioning member 17, wherein the positioning member 17 is engaged with the outer ring gear 15, two ends of the outer ring gear 15 are provided with sliding bearings 16, the sliding bearing 16 is circumferential movably connected with the shell 12, a compressed spring 18 is sleeved on the positioning member 17, the end of outer ring gear 15 is abutted with the guide groove 19 on the shell 12, the outer ring gear 15 is fixedly connected with the hanger rod 5, one end of the adjusting button 13 is hinged with the shell 12, and the other end of the adjusting button 13 is hinged with the positioning member 17. A waist-shaped hole 14 is formed on the adjusting button 13 and located at the site where the adjusting button 13 is hinged with the shell 12, the pin roll 20 located on the shell 12 moves along the waist-shaped hole 14, and the adjusting connecting rod 10 is fixedly connected with the shell 12.

The positioning member 17 is a stepped pin, an engaging member 21 (meshing member) that is engaged with the outer ring gear 15 is located at the large diameter end of the stepped pin, and the small diameter end of the stepped pin is hinged with the adjusting button 13. The compressed spring 18 is located at the small diameter end of the stepped pin, wherein one side of the compressed spring 18 is abutted with the large diameter end of the stepped pin, and the other side of the compressed spring is abutted with the guide groove 19 on the shell 12. The stepped pin is integrally cast with the engaging member 21 (meshing member).

When an outside force is applied on the adjusting button 13, the compressed spring 18 is compressed, and the positioning member 17 is detached from the outer ring gear 15 by moving down Handing the adjust button 13 makes the button 13 take the circumferential movement around the hanger 5, drive the shell 12 rotation, and then drive the adjusting connecting rod 10 rotate the required angle. The adjusting connecting rod 10 is fixedly connected with the adjusting connector 9, and the adjusting connector 9 is fixedly connected with the end sleeve of hanger rod 11, such that the end sleeve of hanger rod 11 is driven by the adjusting connecting rod 10 to do the circumferential movement around the hanger rod 5, the adjusting connector 9 is connected with the upper umbrella plate 8, and then the whole umbrella surface is driven to swing angle, so as to adjust the umbrella surface angle; When the adjusting button 13 is released, the outer ring gear 15 is engaged with the positioning member 17 under the action of the spring force to locate the shell 12 circumferentially, so as to position the umbrella surface angle.

What is claimed is:

1. A sunshade umbrella capable of adjusting umbrella surface angle, including a upright rod and a upright rod handle which moves up and down along the upright rod, wherein one end of the upright rod is connected with umbrella base, the other end of the upright rod is hinged with the connecting rod, the other end of a connecting rod is hinged with a circumferential fixed hanger rod, the hanger rod is hinged with the upright rod handle, an umbrella surface angle adjusting device is mounted on one end of the hanger rod, an executing device that takes the circumferential movement around the hanger rod is mounted on the other end of the hanger rod, and the executing device is connected with an upper umbrella plate; wherein the executing device includes an adjusting connector, an adjusting connecting rod and an end sleeve of hanger rod, wherein the end sleeve of hanger rod is sleeved on the hanger rod, the adjusting connector is fixedly connected with the end sleeve of hanger rod, one end of the adjusting connector is fixedly connected with the adjusting connecting rod, and the other end of the adjusting connector is hinged with the upper umbrella plate, the other end of the adjusting connecting rod is connected with the umbrella surface angle adjusting device.

2. A sunshade umbrella capable of adjusting umbrella surface angle according to claim 1, wherein the umbrella surface angle adjusting device includes a shell, an adjusting button, an outer ring gear and a positioning member, wherein the positioning member is engaged with the outer ring gear, two ends of the outer ring gear are provided with sliding bearings, the sliding bearing is circumferential movably connected with the shell, a compressed spring is sleeved on the positioning member, the end of outer ring gear is abutted with a guide groove on the shell, the outer ring gear is fixedly connected with the hanger rod, one end of the adjusting button is hinged with the shell, the other end of the adjusting button is hinged with the positioning member, a waist-shaped hole is formed on the adjusting button and located at the site where the adjusting button is hinged with the shell, a pin roll that is located on the shell moves along the waist-shaped hole, and the adjusting connecting rod is fixedly connected with the shell.

3. A sunshade umbrella capable of adjusting umbrella surface angle according to claim 2, wherein the positioning member is a stepped pin, an engaging member that is engaged with the outer ring gear is located at a large diameter end of the stepped pin, a small diameter end of the stepped pin is hinged with the adjusting button, the compressed spring is located at the small diameter end of the stepped pin, one side of the compressed spring is abutted with the large diameter end of the stepped pin, and the other side of the compressed spring is abutted with the guide groove on the shell.

4. A sunshade umbrella capable of adjusting umbrella surface angle according to claim 3, wherein the stepped pin is integrally molded with the engaging member.

5. A sunshade umbrella capable of adjusting umbrella surface angle according to claim 1, wherein the umbrella surface angle adjusting device includes a shell, an adjusting button, an outer ring gear and a positioning member, wherein the positioning member is engaged with the outer ring gear.

6. A sunshade umbrella capable of adjusting umbrella surface angle according to claim 5, wherein two ends of the outer ring gear are provided with sliding bearings and the sliding bearing is circumferential movably connected with the shell.

7. A sunshade umbrella capable of adjusting umbrella surface angle according to claim 5, wherein a compressed spring is sleeved on the positioning member.

8. A sunshade umbrella capable of adjusting umbrella surface angle according to claim 5, wherein the end of outer ring gear is abutted with a guide groove on the shell and the outer ring gear is fixedly connected with the hanger rod.

9. A sunshade umbrella capable of adjusting umbrella surface angle according to claim 5, wherein one end of the adjusting button is hinged with the shell and the other end of the adjusting button is hinged with the positioning member.

10. A sunshade umbrella capable of adjusting umbrella surface angle according to claim 9, wherein a waist-shaped hole is formed on the adjusting button and located at the site where the adjusting button is hinged with the shell.

11. A sunshade umbrella capable of adjusting umbrella surface angle according to claim 10, wherein a pin roll that is located on the shell moves along the waist-shaped hole.

12. A sunshade umbrella capable of adjusting umbrella surface angle according to claim 5, wherein the adjusting connecting rod is fixedly connected with the shell.

13. A sunshade umbrella capable of adjusting umbrella surface angle according to claim 5, wherein the positioning member is a stepped pin.

14. A sunshade umbrella capable of adjusting umbrella surface angle according to claim 13, wherein an engaging member that is engaged with the outer ring gear is located at a large diameter end of the stepped pin.

15. A sunshade umbrella capable of adjusting umbrella surface angle according to claim 14, wherein the stepped pin is integrally molded with the engaging member.

16. A sunshade umbrella capable of adjusting umbrella surface angle according to claim 13, wherein a small diameter end of the stepped pin is hinged with an adjusting button.

17. A sunshade umbrella capable of adjusting umbrella surface angle according to claim 13, wherein a compressed spring is located at the small diameter end of the stepped pin.

18. A sunshade umbrella capable of adjusting umbrella surface angle according to claim 17, wherein one side of the compressed spring is abutted with a large diameter end of the stepped pin.

19. A sunshade umbrella capable of adjusting umbrella surface angle according to claim 17, wherein the other side of the compressed spring is abutted with a guide groove on the shell.

* * * * *

UNITED STATES PATENT AND TRADEMARK OFFICE

CERTIFICATE OF CORRECTION

PATENT NO. : 8,985,129 B2
APPLICATION NO. : 13/942517
DATED : March 24, 2015
INVENTOR(S) : Ren Li and Yunsheng Wang It is certified that error appears in the above-identified patent and that said Letters Patent is hereby corrected as shown below:

On the Title page, after (65) Prior Publication Data, please insert
-- (30) Foreign Application Priority Data
October 29, 2012 (CN)..... 201220556955.1--

Signed and Sealed this
First Day of September, 2015

Michelle K. Lee

Michelle K. Lee
*Director of the United States Patent and Trademark Office*